US005897112A

United States Patent [19]

Kwag

[11] Patent Number: 5,897,112

[45] Date of Patent: Apr. 27, 1999

[54] DEVICE FOR DETECTING AN EMPTY PAPER TRAY IN AN ELECTROPHOTOGRAPHIC APPARATUS

[75] Inventor: Dong-Guen Kwag, Suwon, Rep. of Korea

[73] Assignee: SamSung Electronics Co., Ltd., Suwon, Rep. of Korea

[21] Appl. No.: 09/065,906

[22] Filed: Apr. 24, 1998

[30] Foreign Application Priority Data

Apr. 24, 1997 [KR] Rep. of Korea ..... 97-15331

[51] Int. Cl.[6] ..... B65H 1/00; G03G 15/00

[52] U.S. Cl. ..... 271/38; 271/111; 271/162; 399/23; 399/393

[58] Field of Search ..... 399/23, 24, 388, 399/389, 391, 393; 271/38, 110, 111, 112, 162, 164

[56] References Cited

U.S. PATENT DOCUMENTS

| | | | |
|---|---|---|---|
| 4,879,575 | 11/1989 | Maruta et al. . | |
| 4,888,617 | 12/1989 | Okuzawa | 355/203 |
| 4,963,941 | 10/1990 | Negishi et al. . | |
| 5,028,041 | 7/1991 | Kobayashi . | |
| 5,076,563 | 12/1991 | Namba et al. | 271/10 |
| 5,204,726 | 4/1993 | Choi . | |
| 5,332,207 | 7/1994 | Oonishi et al. . | |
| 5,443,359 | 8/1995 | Miller et al. | 271/111 |
| 5,446,524 | 8/1995 | Koike . | |
| 5,629,672 | 5/1997 | Brown et al. | 399/23 |
| 5,700,003 | 12/1997 | Sung | 271/10 |
| 5,745,158 | 4/1998 | Lee | 399/23 |

*Primary Examiner*—Richard Moses
*Assistant Examiner*—Shival Virmani
*Attorney, Agent, or Firm*—Robert E. Bushnell, Esq.

[57] ABSTRACT

A paper detecting device is provided that may be constructed using a tray-rotatable-cam that can rotate around a shaft through a limited range. The tray-rotatable-cam is rotated into operating position by the insertion of the paper tray into the electrophotographic apparatus. A height-adjusting-beam is positioned substantially perpendicularly to the tray-rotatable-cam and is able to rotate on its own shaft through a limited range to raise the height of the shaft supporting the sensor-activating-blade. The shaft supporting the sensor-activating-blade is at a substantially perpendicular orientation to the height-adjusting-beam. A torsion spring installed on the same shaft as the height-adjusting-beam to provide the force to lift the shaft, and sensor-activating-blade to their operational height. The torsional spring also prevent the shaft and sensor-activating-blade from being caught in the paper tray when the paper tray is inserted or removed from the electrophotographic apparatus. When the cut medium in the paper tray is exhausted, the sensor-activating-blade rotates through a hole in the paper stand and activates a photo sensor signaling the absence of paper in the paper tray.

18 Claims, 7 Drawing Sheets

DEVICE FOR DETECTING AN EMPTY PAPER TRAY IN AN ELECTROPHOTOGRAPHIC APPARATUS

CLAIM OF PRIORITY

This application makes reference to, incorporates the same herein, and claims all rights accruing thereto under 35 U.S.C. §119 through my patent application entitled A Paper Presence/Absence Sensing Apparatus of a Paper Feeding Cassette earlier filed in the Korean Industrial Property Office on the 24th day of April 1997 and there duly assigned Ser. No. 1997/15331.

BACKGROUND OF THE INVENTION

1. Field of the Invention

The present invention relates to a paper tray for an electrophotographic apparatus and, more specifically, to a paper detection device for a paper tray that is inserted into an electrophotographic apparatus in a direction perpendicular to the paper pickup direction.

2. Background Art

An electrophotographic apparatus can be either one of a laser printer, an electronic copier, a facsimile machine, or any versatile office machine. The general operation of an electrophotographic apparatus starts with paper being loaded from a supply tray and then transported through to a high pressure transfer roller. The high pressure transfer roller transfers the toner image from the photoconductive drum onto the sheet of paper. Subsequently, the paper is transported to a fixing device that fuses the toner image onto the paper using both heat and pressure rollers.

A paper tray may be mounted on the bottom of an electrophotographic apparatus body to sequentially feed individual cut sheets of paper to the electrophotographic apparatus. Some paper trays are designed so that the direction that the paper tray is inserted and withdrawn in is perpendicular to the paper pickup direction. When cut sheets of paper are in the paper tray, a pickup roller is in contact with the topmost sheet in the stack. The pickup roller then feeds the cut sheets, one by one, into the electrophotographic apparatus. A paper detection device for use with a paper tray that contains a paper stand that moves perpendicularly relative to the base of the paper tray. Paper is stacked on the paper stand and the topmost sheet is removed by a pickup roller that exerts a frictional force on the paper.

After a user inserts paper into the paper tray, the tray is inserted into the electrophotographic apparatus. The side of the paper stand that is along the edge at which the paper is picked up by the pickup roller is displaced in an direction away from the base of the paper tray. This brings the topmost sheet of paper into contact with the pickup roller to allow the paper to be fed into the apparatus.

An optical sensor is installed on the apparatus body and an optical transmission hole is positioned at one side of the paper stand aligned in opposition with the optical sensor. Thus, when paper is in the paper tray, light generated by the optical sensor is reflected off of the paper and received by the optical sensor. When the paper tray is empty the light emitted by the optical sensor passes through the transmission hole and the optical sensor detects the absence of paper.

Different techniques for monitoring the paper in a paper tray are shown, for example, in U.S. Pat. No. 4,879,575 to Maruta entitled Copying Apparatus With Provision for Delayed Reset in the Event of Paper Exhaustion, U.S. Pat. No. 5,028,041 to Kobayashi entitled Image Forming Apparatus With Sheet Feeder, U.S. Pat. No. 5,332,207 to Oonishi entitled Paper Feeder and an Image Forming Apparatus Provided With the Same, U.S. Pat. No. 5,446,524 to Koike entitled Image Forming Device with a Function of Selecting Recording Paper, U.S. Pat. No. 4,963,941 to Negishi entitled Form Feeding Control Device, and U.S. Pat. No. 5,204,726 to Choi entitled Copying Paper Feed Sensing Device for a Copying Apparatus. The contemporary art for detecting paper in paper trays does not provide a device that is economical to manufacture, that uses only simple components, that will function with transparencies and other transparent cut mediums, that will detect an empty paper tray, that are designed for paper trays that attach to electrophotographic apparatus that engage the paper tray in a direction substantially perpendicular to the paper pickup direction.

As such, I believe that it may be possible to improve on the contemporary art by providing a device that detects the presence of paper in a paper tray, that is designed for a paper tray that is inserted into an electrophotographic apparatus in a direction substantially perpendicular to the paper pickup direction, that is economical to manufacture, that is constructed using simple components, and that accurately functions when using transparent cut medium.

SUMMARY OF THE INVENTION

Accordingly, it is an object of the present invention to provide an improved paper detection device for an electrophotographic apparatus.

It is another object to provide a paper detection device for an electrophotographic apparatus that detects the presence of paper in a paper tray.

It is still another object to provide a paper detection device for an electrophotographic apparatus that is designed for a paper tray that is inserted into an electrophotographic apparatus in a direction substantially perpendicular to the paper pickup direction.

It is yet another object to provide a paper detection device for an electrophotographic apparatus that is economical to manufacture, thus decreasing the cost of the electrophotographic apparatus and increasing market competitiveness of the electrophotographic apparatus.

It is still yet another object to provide a paper detection device for an electrophotographic apparatus that is constructed using simple components that are easy to maintenance and repair.

It is a further object to provide a paper detection device for an electrophotographic apparatus that accurately functions when using transparent cut medium.

A paper detection device designed in accordance with the principles of the present invention works in conjunction with a paper tray to detect the presence of a cut medium on a paper stand inside of a paper tray. The paper detecting device may be constructed using a tray-rotatable-cam that can rotate around a shaft through a limited range. The tray-rotatable-cam is rotated into operating position by the insertion of the paper tray into the electrophotographic apparatus. A height-adjusting-beam is positioned substantially perpendicularly to the tray-rotatable-cam and is able to rotate on its own shaft through a limited range to raise the height of the shaft supporting the sensor-activating-blade. The shaft supporting the sensor-activating-blade is at a substantially perpendicular orientation to the height-adjusting-beam. A torsion spring installed on the same shaft as the height-adjusting-beam to provide the force to lift the shaft, and sensor-activating-blade to their operational height. The torsional spring also prevents the shaft and sensor-activating-blade from being caught in the paper tray when the paper tray is inserted or removed from the electrophotographic apparatus. When the cut medium in the paper tray is exhausted, the sensor-activating-blade rotates through a hole in the paper stand and activates a photo sensor signaling the absence of paper in the paper tray.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein:

FIG. 5 is a front view illustrating the positions that the tray-rotatable-cam of the paper detection device can be rotated through;

DETAILED DESCRIPTION OF THE PREFERRED EMBODIMENT

Figure 1:
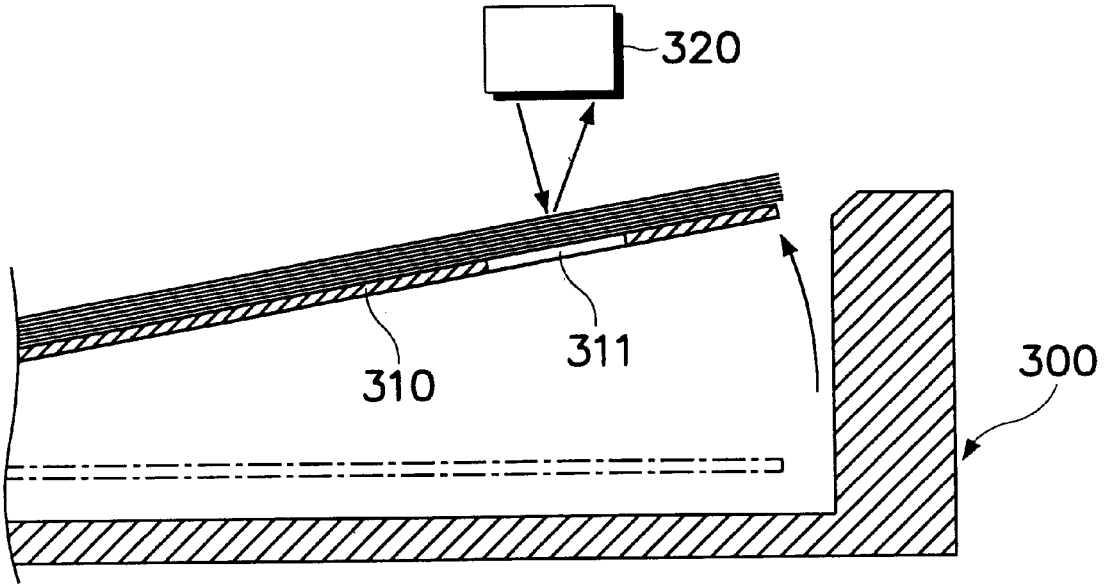
FIG. 1 is a schematic diagram of a paper detection device.

Turning now to the drawings, FIG. 1 illustrates a paper detection device that is used in conjunction with a paper tray. Inside of paper tray 300, paper stand 310 is installed that moves perpendicularly to the plane of the base of the paper tray. Paper is stacked on paper stand 310 and the topmost sheet is removed by a pickup roller that exerts a frictional force on the paper.

If the user pulls out paper tray 300 from the electrophotographic apparatus, paper stand 310 is situated in a position indicated by alternating long and short dashed lines. After a user inserts paper into the paper tray, paper tray 300 is inserted into the electrophotographic apparatus. The side of paper stand 310 that is along the edge at which the paper is picked up by the pickup roller is displaced in an direction away from the base of the paper tray. This brings the paper into contact with the pickup roller to allow the paper to be fed into the apparatus.

Optical sensor 320 is installed on the apparatus body and optical transmission hole 311 is positioned at one side of paper stand 310 that is aligned in front of the optical sensor. Thus, when there is paper in the paper tray, the light that is generated by the optical sensor is reflected off of the paper and received by the optical sensor. When the paper tray is empty, the light emitted by the optical sensor passes through the transmission hole in the paper stand and the optical sensor determines that the paper in the paper tray is exhausted.

Figure 2:
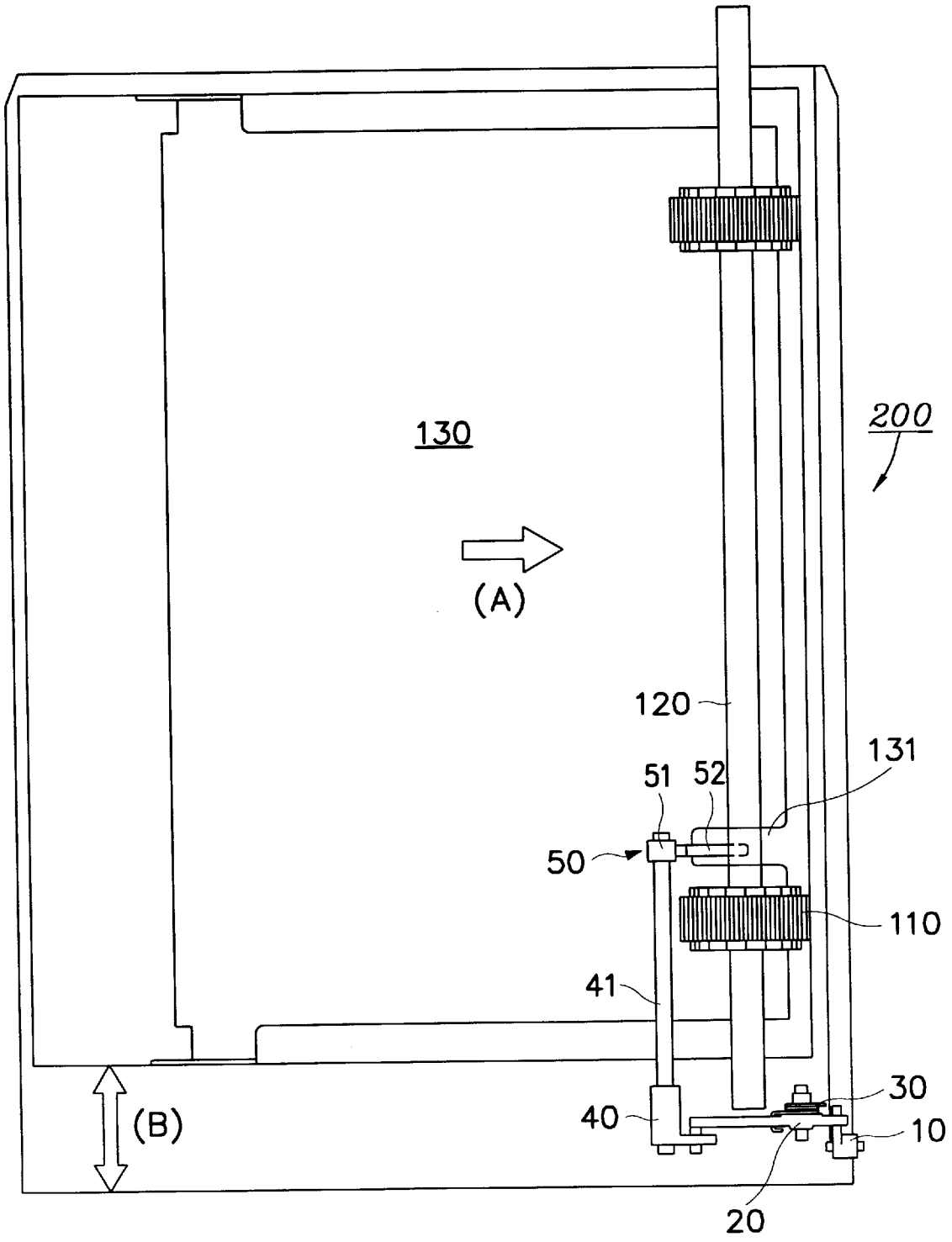
FIG. 2 is a plan view of a paper detection device as constructed according to the principles of the present invention.

A paper detecting device as constructed according to the principles of the present invention is shown in FIG. 2. Height-adjusting-beam 20 is attached at a substantially perpendicular orientation to tray-rotatable-cam 10. Torsion spring 30 provides a force to height-adjusting-beam 20 raising the remaining components of the paper detecting device to it operational height above the paper tray. Shaft connector 40 secures shaft 41 to height-adjusting-beam 20 in a substantially perpendicular orientation. Contact-sensing-structure 50 is installed on shaft 41 on an end opposite that attached to shaft connector 40. Contact-sensing-structure 50 may be constructed using sensor-activating-blade 51 that has weighted portion 52 at an end opposite the end connected to shaft 41. The shaft connector, shaft, and contact-sensing-structure are integrally formed with the weighted portion of the contact-sensing-structure causing all three to rotate around the connection between the shaft connector and the height-adjusting-beam. Photo sensor 60 senses the exhaustion of paper in paper tray 200 depending on the via the position of contact-sensing-structure 50. Arrow A indicates direction that the pickup rollers remove paper from the paper tray. Arrows B denote the direction that the paper tray is manipulated in to be inserted or removed from the electrophotographic apparatus.

Figure 3:
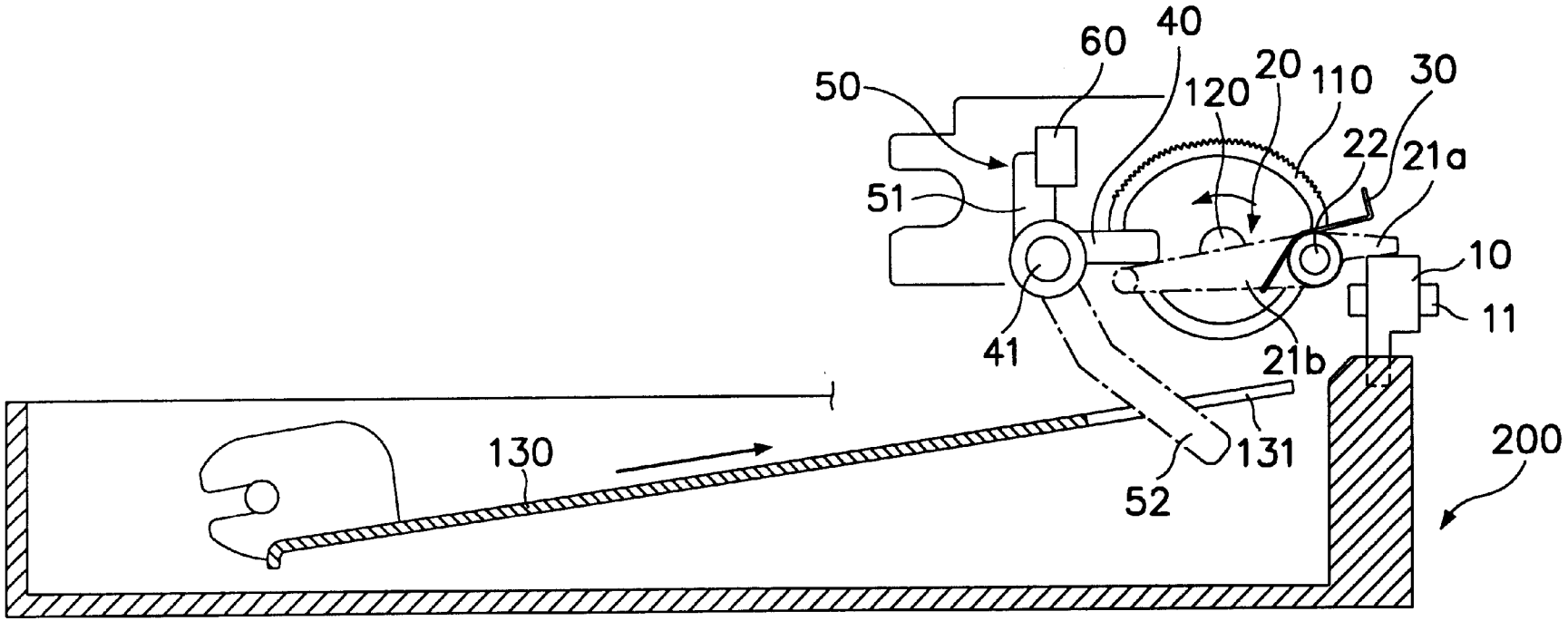
FIG. 3 is a side view of the paper detection device of FIG. 2.
Figure 4:
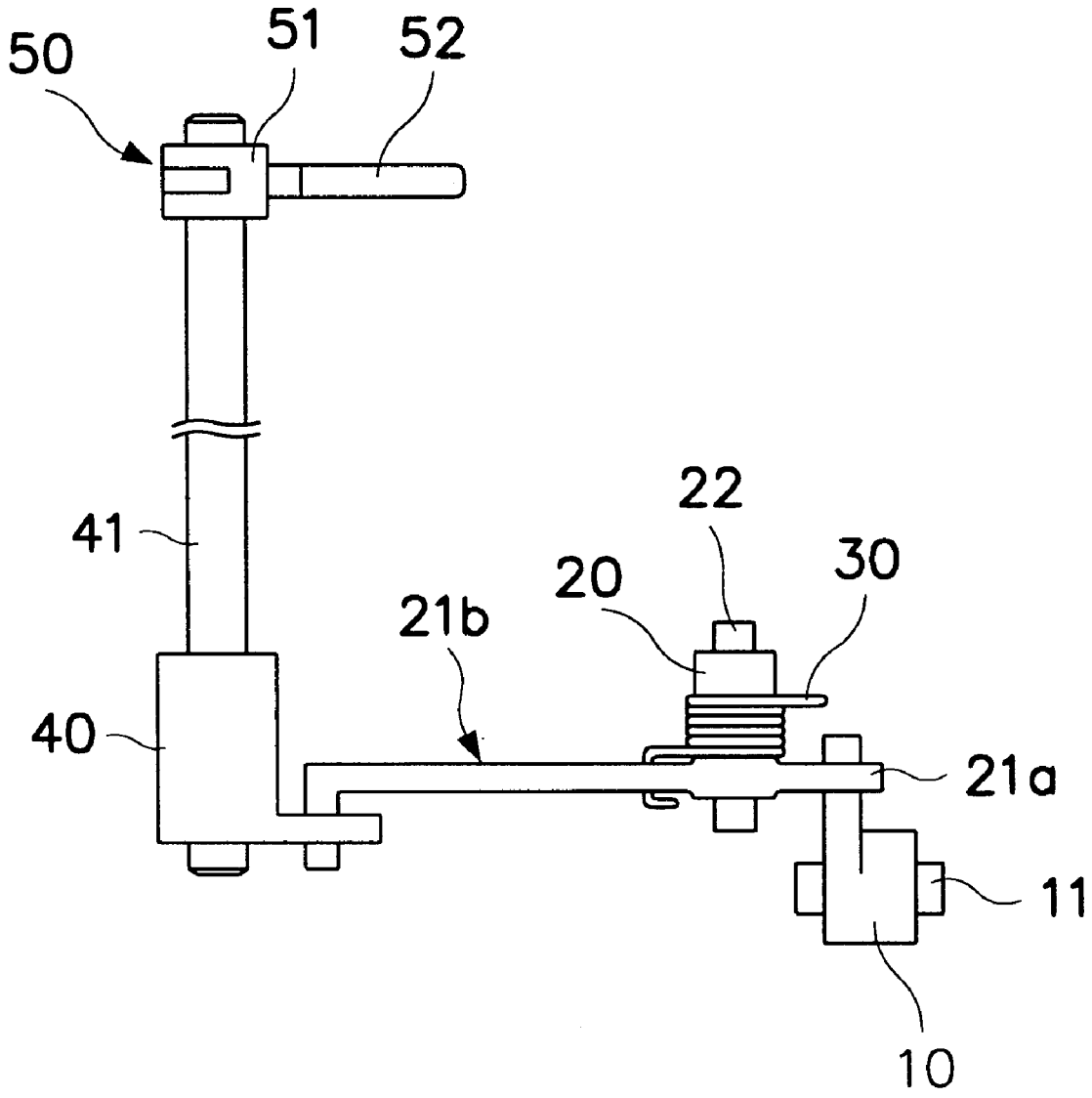
FIG. 4 is a plan view showing the salient parts of the paper detection device of FIG. 2.

As shown in FIGS. 3 and 4, tray-rotatable-cam 10 revolves on apparatus shaft 11. If the tray is moved in a straight line in the tray insert and remove direction, tray-rotatable-cam 10 that is pivotally attached to apparatus shaft 11 is rotated through a limited range by a projection formed around the front of paper tray 200. Height-adjusting-beam 20 is interlocked with tray-rotatable-cam 10. One side 21*a* of height-adjusting-beam 20 is rotated by tray-rotatable-cam 10, and the other side 21*b* of height-adjusting-beam 20 provides a turning force to shaft connector 40. Torsion spring 30 is installed to support height-adjusting-beam 20 in its operational position. The force provided by torsion spring 30 revolves height-adjusting-beam 20 in a clockwise direction, as viewed in FIG. 3. Spring shaft 22 that is part of height-adjusting-beam 20 is oriented in a direction substantially perpendicular to the paper pickup direction. Since torsion spring 30 provides force to height-adjusting-beam 20, weighted portion 52 is not caught on either paper stand 130 or paper tray 200 when paper tray 200 is removed from the electrophotographic apparatus.

Shaft connector 40 is rotated counterclockwise by the side 21*b* of height-adjusting-beam 20. Shaft 41 is oriented substantially parallel to spring shaft 22 of height-adjusting-beam 20. Contact-sensing-structure 50 is constructed using sensor-activating-blade 51 that has a weighted portion 52. Shaft connector 40, shaft 41, and contact-sensing-structure 50 are integrally formed and rotate together. The weighted portion of sensor-activating-blade 51 rotates the sensor-activating-blade, shaft, and shaft connector around the pivotal connection between the shaft connector and the height-adjusting-beam. The rotation of the contact-sensing-structure causes photo sensor 60 to determine whether there is paper in the paper tray. Through hole 131 is formed in a portion of paper stand 130 at a position corresponding to the sensor-activating-blade's path of rotation. This allows the sensor-activating-blade to rotate through hole 131 when there is an absence of paper in the paper tray.

Figure 5:
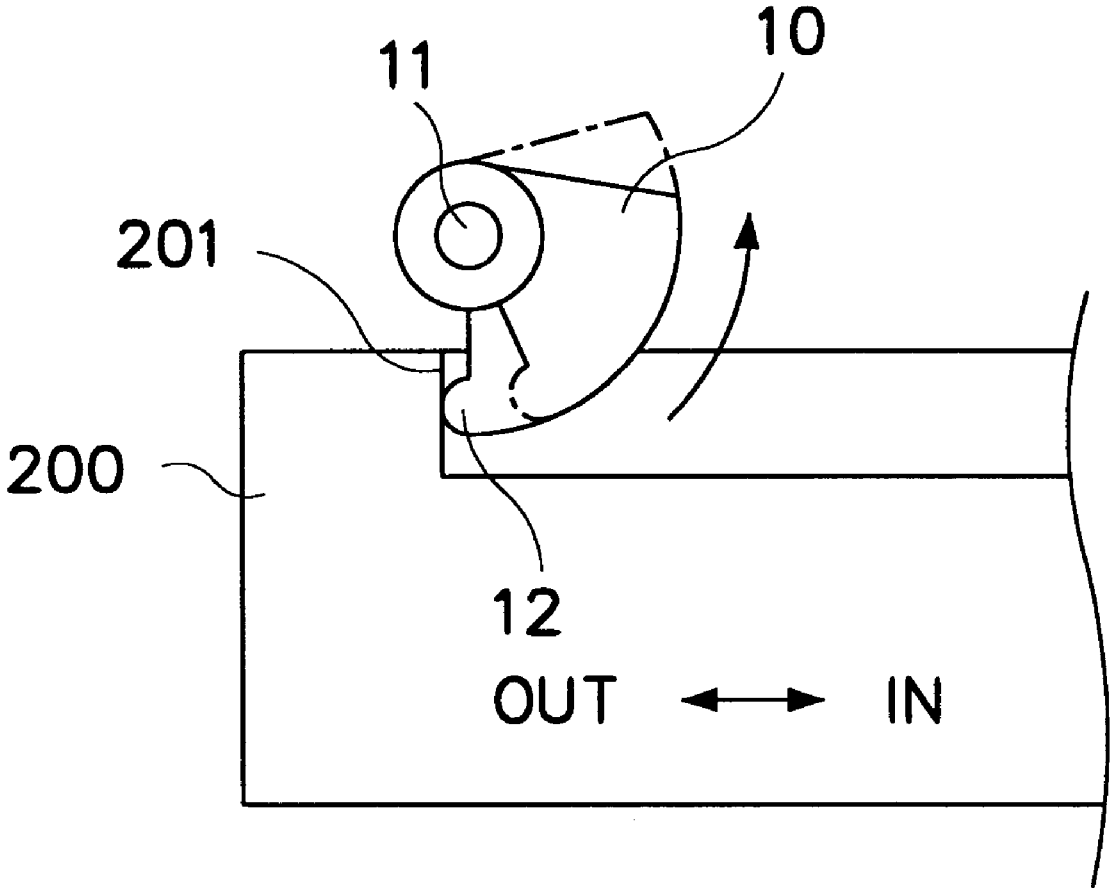

FIG. 5 illustrates the operational range of motion of tray-rotatable-cam 10. If paper tray 200 is inserted into the processor body, paper stand 130 is moved into a vertical position, by a lift means (not shown), allowing a topmost cut sheet to be loaded into the electrophotographic apparatus by a pickup roller. As paper tray 200 is inserted into the electrophotographic apparatus, projection 201, that is positioned on the front of paper tray 200, pushes tray-rotatable-cam 10 counterclockwise. Semicircular abutment 12 is formed at one side of the tray-rotatable-cam 10 to enable projection 201 to more easily push tray-rotatable-cam 10 into the operational position.

Figure 6:
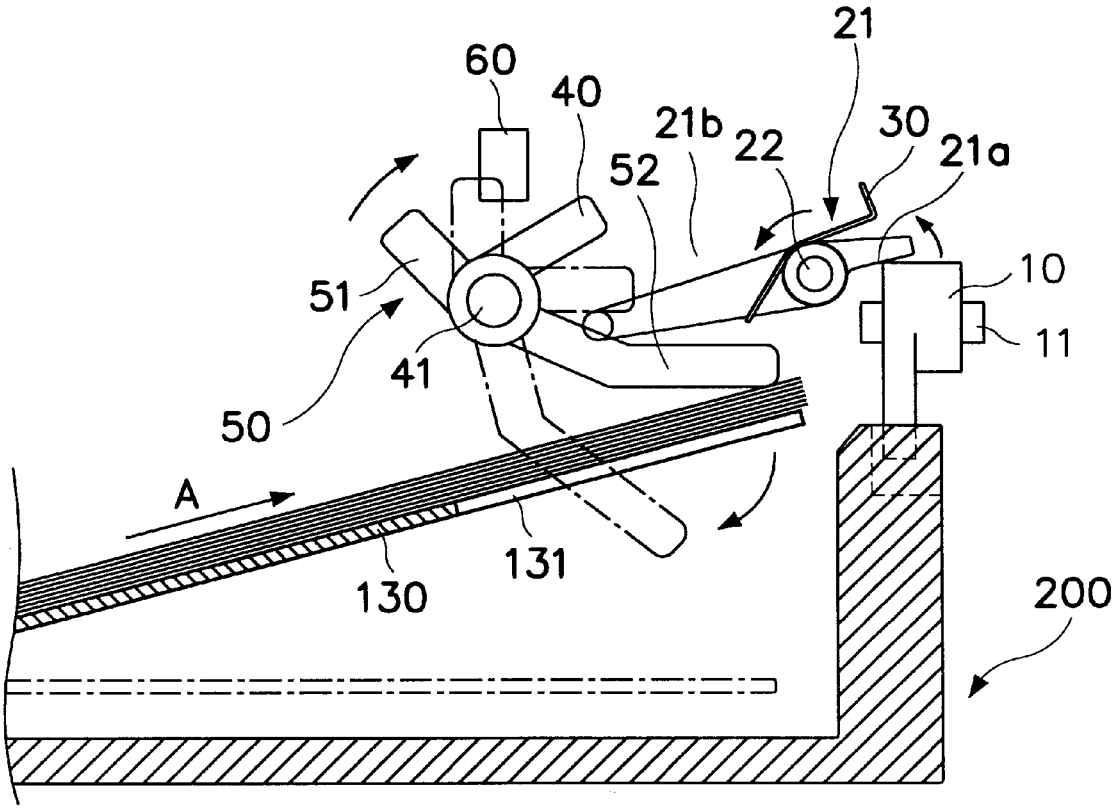
FIG. 6 is a side view illustrating various operational positions of the paper detection device of FIG. 2.

FIG. 6 illustrates an operational position for the paper detection device when paper tray 200 is fully inserted into the electrophotographic apparatus. Side 21*a* of height-adjusting-beam 20 is in contact with the upper portion of tray-rotatable-cam 10 and is also moved counterclockwise by the rotation of tray-rotatable-cam 10. Side 21*b* of height-adjusting-beam 20 is rotated counterclockwise inside of a space in shaft connector 40 that allows height-adjusting-beam 20 to rotate in shaft connector 40.

If there is no paper in paper tray 200, shaft connector 40 is rotated clockwise. This occurs because shaft connector 40 is integrally formed with weighted portion 52 of contact-sensing-structure 50. That is, shaft connector 40 is rotated by the weight of weighted portion 52. This is illustrated by alternate long and short dash lines. Contact-sensing-structure 50 is rotated clockwise by the weight of the weighted portion 52, and simultaneously sensor-activating-blade 51 rotates between a light receiving element and a light emitting element of photo sensor 60. Then, weighted portion 52 passes through hole 131 in paper stand 130. Then the photosensor sends a signal indicating to a controller (not shown) that the paper tray is empty.

If paper is loaded onto paper stand 130, contact-sensing-structure 50 maintains the position indicated by the solid lines shown in FIG. 6. Since hole 131 is covered by cut sheets of a printable medium, contact-sensing-structure 50 is prevented from rotating and causing the photosensor to signal an out of medium condition. This method allows the presence of transparencies or other transparent medium to be accurately determined.

Figure 7:
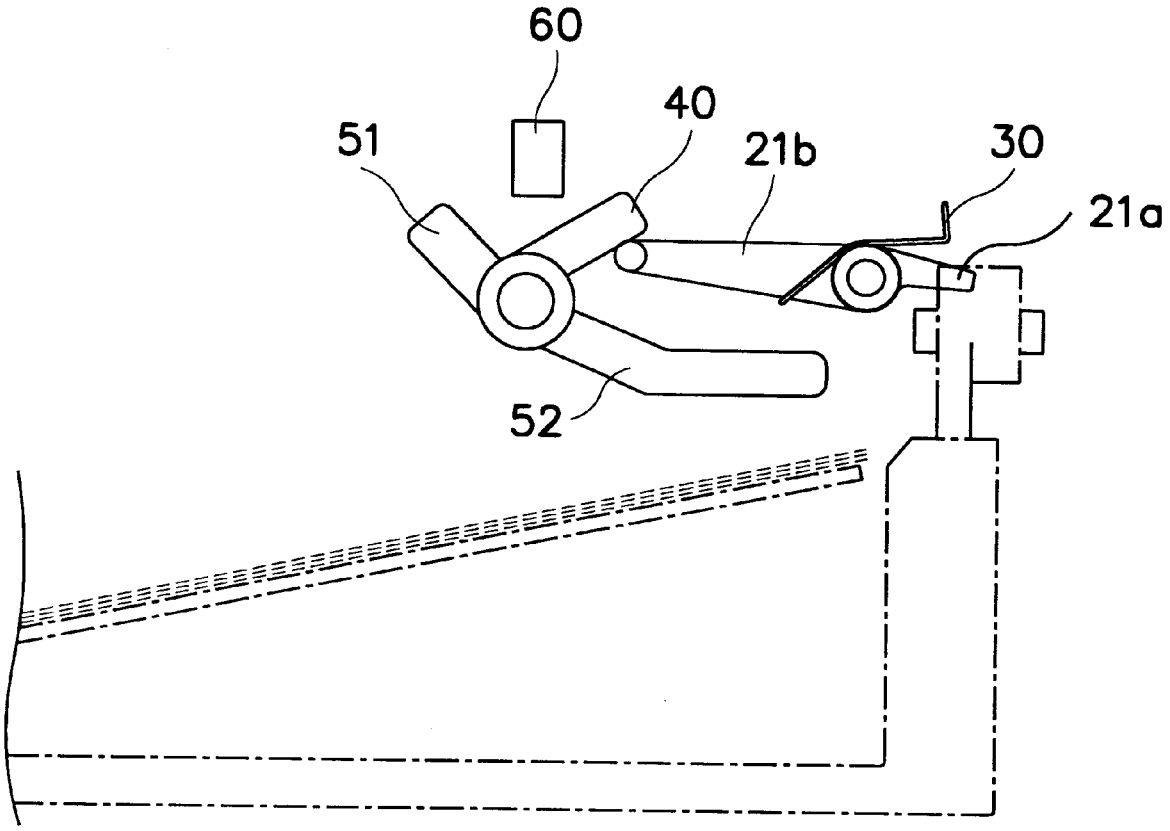
FIG. 7 is a side view illustrating the paper detection device of FIG. 2 when a paper tray is removed from the electrophotographic apparatus body.

FIG. 7 illustrates the operational position of the paper detection device when paper tray 200 is removed from the apparatus body. Elastic force from torsional spring 30 raises height-adjusting-beam 20 and rotating height-adjusting-beam 21 counterclockwise. Side 21*b* of height-adjusting-beam 20 supports shaft connector 40. Force from weighted portion 52 prevents weighted portion 52 from being caught in paper tray 200 when paper tray 200 is removed from the apparatus body. Once paper is loaded into the apparatus via a pickup roller, the paper passes through a conveyer roller (not shown) and an idle roller (not shown) and is fed to the image forming part (not shown) of the electrophotographic apparatus.

Tray-rotatable-cam 10 is rotated when paper tray 200 is inserted into or removed from the apparatus body, and height-adjusting-beam 20 is rotated counterclockwise because of the connection with tray-rotatable-cam 10. Even if the paper tray 200 is inserted into or taken out from the processor body, the weighted portion 52 is not caught in the paper tray 200 by the torsion spring 30.

As described above, in a electrophotographic apparatus with a paper tray insert and removal direction oriented substantially perpendicular to the paper pickup direction. The paper detection device as constructed according to the principles of the present invention has a low manufacturing cost and accurately senses the presence or absence of cut sheets of printable medium in the paper tray.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. An electrophotographic apparatus having a paper detection device, said electrophotographic apparatus comprising:

a pickup roller loading a plurality of cut sheets of a printable medium one sheet at a time, said sheet then being conveyed through a printing section and ejected from said electrophotographic apparatus;

a tray insertable into said electrophotographic apparatus in a direction substantially perpendicular to the direction said sheet is transported during loading, said tray comprising:

a base, a front side, a rear side, and two lateral sides;

a projection positioned on said front side; and a stand contained in said tray, supporting said cut sheets, and having a slot;

a tray-rotatable-cam rotatably connected to a first shaft, said tray-rotatable-cam being rotated into a fixed position while said tray is inserted in said electrophotographic apparatus;

a height-adjusting-beam rotatably attached to a second shaft and positioned in a direction perpendicular to the plane of said tray-rotatable-cam, said height-adjusting-beam comprising:

a first end abutting a topmost portion of said tray-rotatable-cam; and a torsion spring positioned on said second shaft and biasing said height-adjusting-beam towards an equilibrium rotational position depressing said tray-rotatable-cam;

a contact-sensing-structure pivotally attached to said height-adjusting-beam, said contact-sensing-structure comprising:

a beam connected to said height-adjusting-beam in a substantially perpendicular direction;

a sensor-activating-blade attached to said beam; and a weighted-blade attached to said beam;

a photosensor detecting when said sensor-activating-blade of said contact-sensing-structure is in a position indicating an exhaustion of said cut sheets in said tray and sending an out-of-paper-signal; and said tray-rotatable-cam pushing one end of said height-adjusting-beam while said tray-rotatable-cam is in said fixed position and causing said contact-sensing-structure to move into a paper detecting position, said contact-sensing-structure then rotating due to said weighted-blade, said weighted-blade rotating through said slot when said cut sheets in said tray are exhausted and causing said sensor-activating-blade to activate said photosensor.

2. The electrophotographic apparatus of claim 1, further comprised of said front side being near and substantially parallel to said pickup roller.

3. The electrophotographic apparatus of claim 1, further comprising a shaft connector securing said beam to said height-adjusting-beam.

4. The electrophotographic apparatus of claim 1, further comprised of said sensor-activating-blade projecting substantially in a direction substantially opposite from the direction said weighted-blade is projecting.

5. An electrophotographic apparatus having a paper detection device, said electrophotographic apparatus comprising:

a tray insertable into said electrophotographic apparatus in a direction substantially perpendicular to the direction said sheet is transported during loading;

a tray-rotatable-cam rotatably connected to a first shaft, said tray-rotatable-cam being rotated into a fixed position while said tray is inserted in said electrophotographic apparatus;

a height-adjusting-beam rotatably attached to a second shaft and positioned in a direction substantially perpendicular to the plane said tray-rotatable-cam, said height-adjusting-beam comprising:

a first end abutting a topmost portion of said tray-rotatable-cam; and a torsion spring positioned on said second shaft and biasing said height-adjusting-beam towards an equilibrium rotational position depressing said tray-rotatable-cam;

a contact-sensing-structure pivotally attached to said height-adjusting-beam, said contact-sensing-structure comprising:

a beam connected to said height-adjusting-beam in a substantially perpendicular direction;

a sensor-activating-blade attached to said beam; and a weighted-blade attached to said beam; and a photosensor detecting when said sensor-activating-blade of said contact-sensing-structure is in a position indicating an exhaustion of said cut sheets in said tray and sending an out-of-paper-signal.

6. The electrophotographic apparatus of claim 5, further comprising a shaft connector securing said beam to said height-adjusting-beam.

7. The electrophotographic apparatus of claim 6, further comprised of said shaft connector having a L-shape.

8. The electrophotographic apparatus of claim 5, further comprised of said sensor-activating-blade projecting substantially in a direction substantially opposite from the direction said weighted-blade is projecting.

9. The electrophotographic apparatus of claim 5, with said tray further comprising:

a base, a front side, a rear side, and two lateral sides;

a projection positioned on said front side; and a stand contained in said tray, supporting said cut sheets, and having a slot.

10. The electrophotographic apparatus of claim 9, further comprised of said tray-rotatable-cam pushing one end of said height-adjusting-beam while said tray-rotatable-cam is in said fixed position and causing said contact-sensing-structure to move into a paper detecting position, said contact-sensing-structure then rotating due to said weighted-blade, said weighted-blade rotating through said slot when said cut sheets in said tray are exhausted and causing said sensor-activating-blade to activate said photosensor.

11. An electrophotographic apparatus having a paper detection device, said electrophotographic apparatus comprising:

a tray-rotatable-cam rotatably connected to a first shaft, said tray-rotatable-cam being rotated into a fixed position while said tray is inserted in said electrophotographic apparatus;

a height-adjusting-beam rotatably attached to a second shaft and positioned in a direction substantially perpendicular to the plane said tray-rotatable-cam, said height-adjusting-beam having a first end abutting a topmost portion of said tray-rotatable-cam;

a contact-sensing-structure pivotally attached to said height-adjusting-beam, said contact-sensing-structure comprising:

a beam connected to said height-adjusting-beam in a substantially perpendicular direction;

a sensor-activating-blade attached to said beam; and a weighted-blade attached to said beam; and a photosensor detecting when said sensor-activating-blade of said contact-sensing-structure is in a position indicating an exhaustion of said cut sheets in said tray and sending an out-of-paper-signal.

12. The electrophotographic apparatus of claim 11, further comprising a torsion spring positioned on said second shaft and biasing said height-adjusting-beam towards an equilibrium rotational position depressing said tray-rotatable-cam.

13. The electrophotographic apparatus of claim 12, further comprising a tray insertable into said electrophotographic apparatus in a direction substantially perpendicular to the direction said sheet is transported during loading.

14. The electrophotographic apparatus of claim 11, further comprising a shaft connector securing said beam to said height-adjusting-beam.

15. The electrophotographic apparatus of claim 13, further comprised of said sensor-activating-blade projecting substantially in a direction substantially opposite from the direction said weighted-blade is projecting.

16. The electrophotographic apparatus of claim 15, with said tray further comprising:

a base, a front side, a rear side, and two lateral sides;

a projection positioned on said front side; and a stand contained in said tray, supporting said cut sheets, and having a slot.

17. The electrophotographic apparatus of claim 16, further comprised of said projection abutting said tray-rotatable-cam while said tray is inserted in said electrophotographic apparatus and rotating said tray-rotatable-cam.

18. The electrophotographic apparatus of claim 17, further comprised of said tray-rotatable-cam pushing one end of said height-adjusting-beam while said tray-rotatable-cam is in said fixed position and causing said contact-sensing-structure to move into a paper detecting position, said contact-sensing-structure then rotating due to said weighted-blade, said weighted-blade rotating through said slot when said cut sheets in said tray are exhausted and causing said sensor-activating-blade to activate said photosensor.

* * * * *